US011007412B2

(12) United States Patent
Takasu

(10) Patent No.: US 11,007,412 B2
(45) Date of Patent: May 18, 2021

(54) GOLF CLUB SHAFT

(71) Applicant: Sumitomo Rubber Industries, Ltd., Hyogo (JP)

(72) Inventor: Kenji Takasu, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/834,020

(22) Filed: Mar. 30, 2020

(65) Prior Publication Data

US 2020/0338409 A1 Oct. 29, 2020

(30) Foreign Application Priority Data

Apr. 23, 2019 (JP) ..... JP2019-082251

(51) Int. Cl.
*A63B 53/10* (2015.01)

(52) U.S. Cl.
CPC ..... *A63B 53/10* (2013.01); *A63B 2209/02* (2013.01)

(58) Field of Classification Search
CPC ..... A63B 53/10; A63B 2209/02
See application file for complete search history.

(56) References Cited

U.S. PATENT DOCUMENTS 6,306,047 B1 10/2001 Kusumoto
7,803,063 B2 * 9/2010 Kumamoto ..... A63B 60/00 473/319
7,918,746 B2 * 4/2011 Kumamoto ..... A63B 53/10 473/319
8,465,612 B2 * 6/2013 Kumamoto ..... A63B 60/00 156/192
9,119,994 B2 * 9/2015 Nakamura ..... A63B 53/00
9,399,159 B2 * 7/2016 Nakamura ..... A63B 53/10
9,795,847 B2 * 10/2017 Nakamura ..... A63B 53/10
10,086,245 B2 * 10/2018 Nakano ..... A63B 53/10
10,420,995 B2 * 9/2019 Takasu ..... A63B 1/00
2004/0009827 A1 1/2004 Oyama
2012/0165113 A1 6/2012 Kato
2014/0106895 A1 * 4/2014 Hasegawa ..... A63B 53/10 473/319
2014/0155190 A1 6/2014 Nakamura
2018/0001166 A1 1/2018 Nakano
2019/0009148 A1 1/2019 Takasu et al.

FOREIGN PATENT DOCUMENTS

JP H11170197 A 3/1999
JP 2005323829 A 11/2005
JP 4125920 B2 7/2008
JP 2012130533 A 7/2012
JP 2014131624 A 7/2014
JP 2018000397 A 1/2018
JP 2019013458 A 1/2019

* cited by examiner

*Primary Examiner* — Stephen L Blau
(74) *Attorney, Agent, or Firm* — Studebaker & Brackett PC

(57) ABSTRACT

A shaft includes a plurality of fiber reinforced layers. The fiber reinforced layers include a plurality of hoop layers and a plurality of straight layers. The straight layers include at least one full length straight layer. At least two of the hoop layers and at least two of the straight layers constitute an alternate lamination of the hoop layers and the straight layers. The hoop layers may include a first butt partial hoop layer and a second butt partial hoop layer that is longer in an axial direction than the first butt partial hoop layer. The first butt partial hoop layer may have a weight per unit area of greater than that of the second butt partial hoop layer.

14 Claims, 3 Drawing Sheets

GOLF CLUB SHAFT

The present application claims priority on Patent Application No. 2019-082251 filed in JAPAN on Apr. 23, 2019. The entire contents of this Japanese Patent Application are hereby incorporated by reference.

BACKGROUND OF THE INVENTION

Field of the Invention

The present invention relates to golf club shafts.

Description of the Related Art

There has been demand for a high-performance and lightweight shaft. JP4125920B2 (US2004/0009827A1) discloses a lightweight shaft obtained by laminating prepregs containing reinforcing fibers having a high elasticity and high strength.

SUMMARY OF THE INVENTION

The inventor of the present disclosure conducted thorough researches for further improvement of golf club shafts and has found a new structure that can achieve a further high performance.

The present disclosure provides a high-performance golf club shaft.

A golf club shaft according to one aspect includes a plurality of fiber reinforced layers. The fiber reinforced layers include a plurality of hoop layers and a plurality of straight layers. The straight layers include at least one full length straight layer. At least two of the hoop layers and at least two of the straight layers constitute an alternate lamination of the hoop layers and the straight layers.

DESCRIPTION OF THE PREFERRED EMBODIMENTS

The following will describe in detail the present disclosure based on preferred embodiments with appropriate reference to the drawings.

In the present disclosure, the term "axial direction" means the axial direction of a shaft. In the present disclosure, the term "circumferential direction" means the circumferential direction of the shaft. In the present disclosure, the term "inside" means the inside in the radial direction (radial inside) of the shaft. In the present disclosure, the term "outside" means the outside in the radial direction (radial outside) of the shaft.

Figure 1:
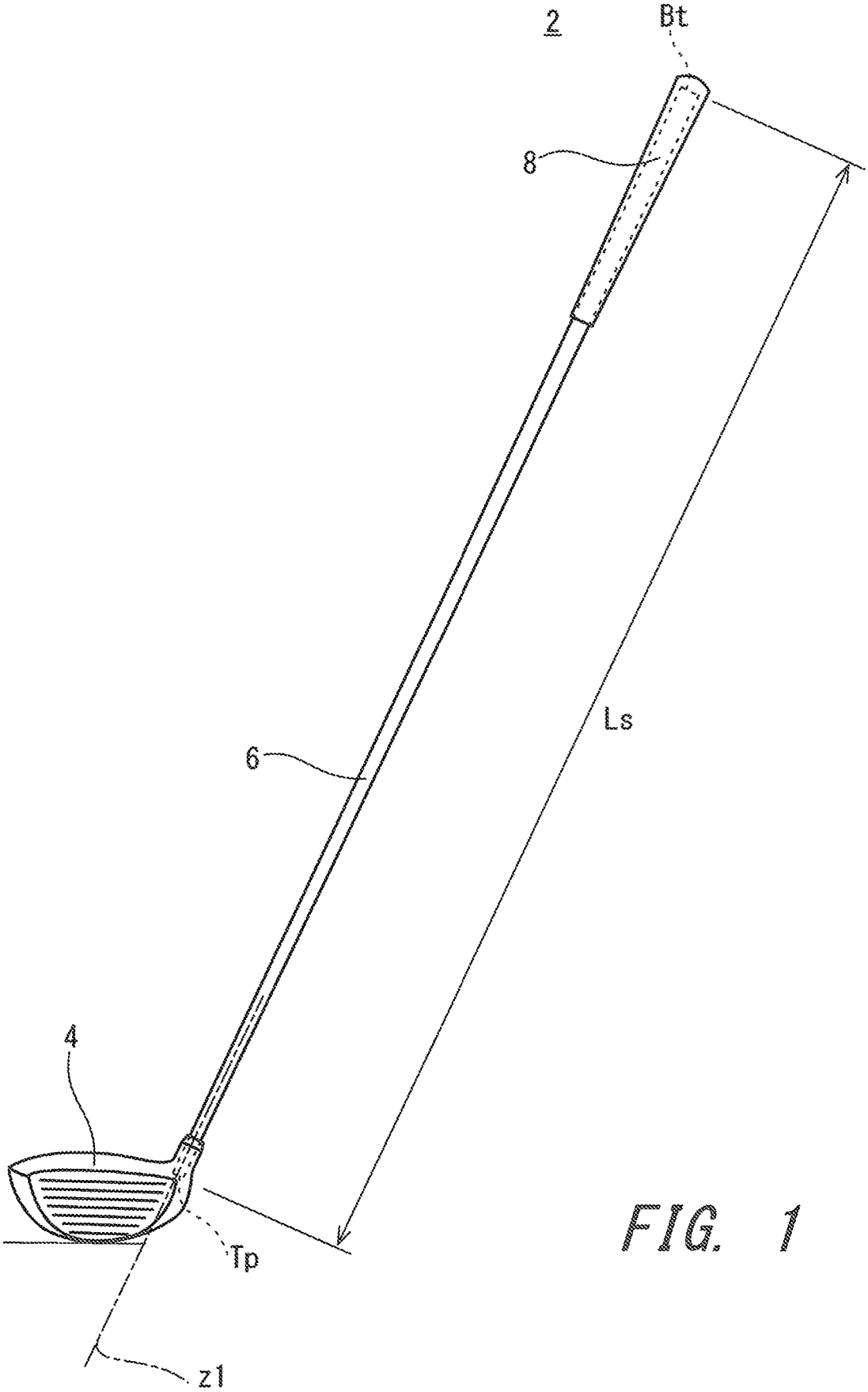
FIG. 1 shows a golf club in which a shaft according to an embodiment is attached.
Figure 2:
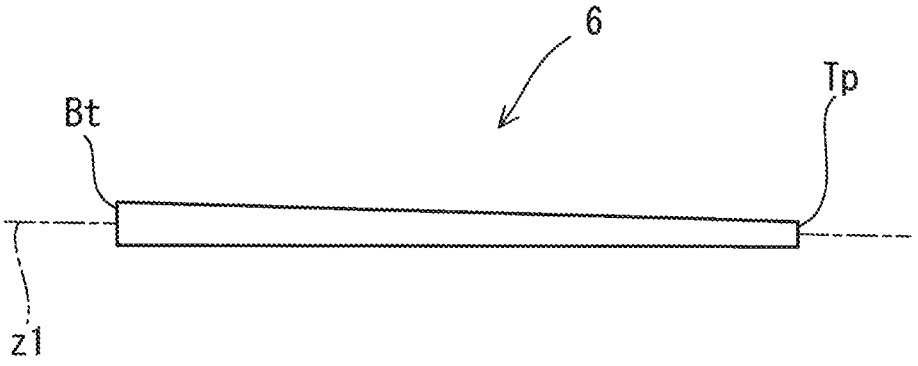
FIG. 2 shows the shaft used for the golf club in FIG. 1.

FIG. 1 shows a golf club 2 including a shaft 6 according to an embodiment. FIG. 2 shows the shaft 6. The golf club 2 includes a head 4, the shaft 6, and a grip 8. The head 4 is attached to a tip portion of the shaft 6. The grip 8 is attached to a butt portion of the shaft 6. The shaft 6 has an axis line (center line) z1. The axial direction of the shaft 6 means the direction of the axis line z1.

A double-pointed arrow Ls in FIG. 1 shows the length of the shaft 6. The golf club 2 is a driver (number 1 wood). The shaft 6 is used for drivers. Such a driver shaft usually has a length Ls of longer than or equal to 43 inches and shorter than or equal to 47 inches. The length of the shaft 6 in the present disclosure is not limited. The club number of a golf club in which the shaft 6 is attached is not limited.

The shaft 6 is a laminate of fiber reinforced resin layers. The shaft 6 is a tubular body. The shaft 6 has a hollow structure. The shaft 6 includes a tip end Tp and a butt end Bt. In the golf club 2, the tip end Tp is located in the head 4. The butt end Bt is located in the grip 8.

The shaft 6 is a so-called carbon shaft. Preferably, the shaft 6 is formed by curing a wound prepreg sheet. In the prepreg sheet, fibers are oriented substantially in one direction. Such a prepreg in which fibers are oriented substantially in one direction is also referred to as a UD prepreg. The term "UD" stands for uni-direction. Prepregs which are not the UD prepreg may be used. For example, fibers contained in the prepreg sheet may be woven.

The prepreg sheet includes a fiber and a resin. The resin is also referred to as a matrix resin. Typically, the fiber is a carbon fiber. Typically, the matrix resin is a thermosetting resin.

The shaft 6 is manufactured by a so-called sheet-winding method. In the prepreg, the matrix resin is in a semi-cured state. The shaft 6 is obtained by winding and curing the prepreg sheet.

In addition to an epoxy resin, a thermosetting resin other than the epoxy resin or a thermoplastic resin, etc. can be used for the matrix resin of the prepreg sheet. From the viewpoint of shaft strength, the matrix resin is preferably the epoxy resin.

Figure 3:
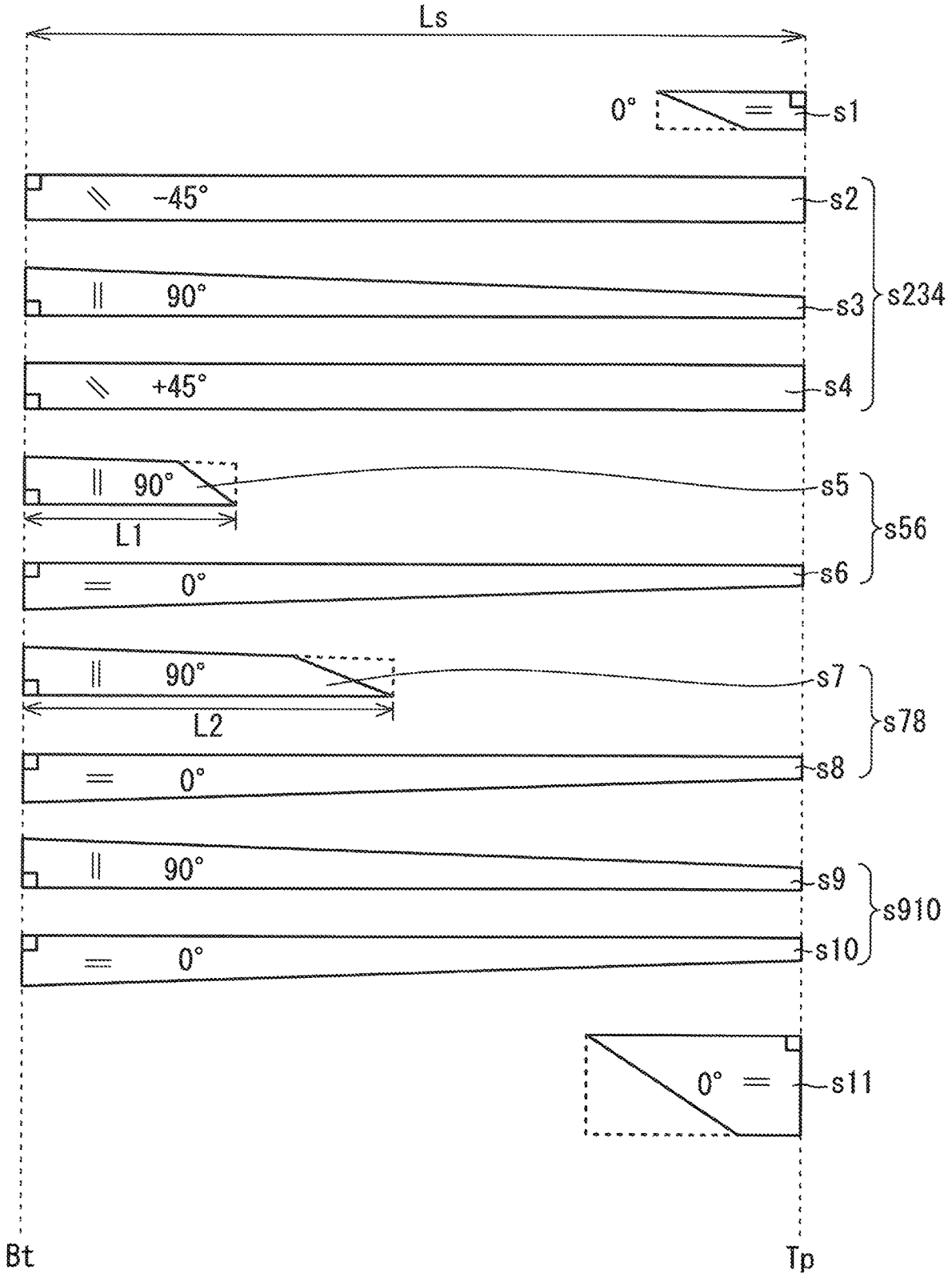
FIG. 3 is a developed view showing a laminated constitution of the shaft in FIG. 2.

FIG. 3 is a developed view (laminated constitution view) of prepreg sheets constituting the shaft 6.

The shaft 6 is constituted by a plurality of sheets. The shaft 6 is constituted by 11 sheets of a first sheet s1 to an eleventh sheet s11. The developed view shows the sheets constituting the shaft in order from the radial inside of the shaft. The sheets are wound in order from the sheet located on the uppermost side in the developed view. In the developed view, the horizontal direction of the figure coincides with the axial direction of the shaft.

The developed view shows not only the winding order of the sheets but also the disposal of each of the sheets in the axial direction of the shaft. For example, in FIG. 3, an end of the first sheet s1 is located at the tip end Tp. For example, in FIG. 3, an end of the fifth sheet s5 is located at the butt end Bt.

The term "layer" and the term "sheet" are used in the present disclosure. The "layer" is a term for after being wound. Meanwhile, the "sheet" is a term for before being wound. The "layer" is formed by winding the "sheet". That is, the wound "sheet" forms the "layer". In the present disclosure, the same symbol is used in the layer and the sheet. For example, a layer formed by a sheet s1 is a layer s1.

The shaft 6 includes a straight layer, a bias layer, and a hoop layer. An orientation angle of the fiber is described for each of the sheets in the developed view of the present disclosure. The orientation angle is an angle with respect to the axial direction the shaft.

The shaft 6 includes a plurality of straight layers. Sheets described as "0°" form the straight layers. The sheet forming the straight layer is also referred to as a straight sheet.

The straight layer is a layer in which the fiber orientation angle is substantially set to 0 degree. Usually, the orientation angle is not completely set to 0 degree due to error or the like in winding. Usually, in the straight layer, an absolute angle is less than or equal to 10 degrees. The absolute angle means an absolute value of the orientation angle. For example, "the absolute angle is less than or equal to 10 degrees" means that "the orientation angle is −10 degrees or greater and +10 degrees or less".

In the embodiment of FIG. 3, the straight sheets are the sheet s1, the sheet s6, the sheet s8, the sheet s10, and the sheet s11.

The shaft 6 includes a plurality of bias layers. Sheet described as "−45°" and "+45°" form the bias layers. The shaft 6 includes two bias layers. Three or more bias layers may be provided.

The bias layers are highly correlated with the torsional rigidity and torsional strength of the shaft. Preferably, the bias sheets include a pair of sheets in which fiber orientation angles of the respective sheets are inclined inversely to each other. From the viewpoint of the torsional rigidity, the absolute angle of the fiber of each bias layer is preferably greater than or equal to 15 degrees, more preferably greater than or equal to 25 degrees, and still more preferably greater than or equal to 40 degrees. From the viewpoint of the torsional rigidity and flexural rigidity, the absolute angle of the fiber of the bias layer is preferably less than or equal to 60 degrees, and more preferably less than or equal to 50 degrees. In the present embodiment, the absolute angle of the fiber of the bias layer is 45 degrees.

In the shaft 6, the sheets constituting the bias layers are the second sheet s2 and the fourth sheet s4. As described above, in FIG. 3, the orientation angle is described in each sheet. The plus (+) and minus (−) in the orientation angle show that the fibers of respective bias sheets are inclined inversely to each other. In the present disclosure, the sheet constituting the bias layer is also simply referred to as a bias sheet. The sheet s2 and the sheet s4 constitute a united sheet to be described later.

In FIG. 3, the inclination direction of the fiber of the sheet s4 is equal to the inclination direction of the fiber of the sheet s2. However, the sheet s4 is reversed, and applied on the sheet s2. As a result, the direction of the orientation angle of the sheet s2 and the direction of the orientation angle of the sheet s4 become inverse to each other. In this respect, in the embodiment of FIG. 3, the orientation angle of the sheet s2 is described as −45 degrees and the orientation angle of the sheet s4 is described as +45 degrees.

The shaft 6 includes a plurality of hoop layers. The shaft 6 includes four hoop layers. In the shaft 6, the hoop layers are a layer s3, a layer s5, a layer s7, and a layer s9. In the shaft 6, the sheets forming the hoop layers are the third sheet s3, the fifth sheet s5, the seventh sheet s7, and the ninth sheet s9. In the present disclosure, the sheet forming the hoop layer is also referred to as a hoop sheet.

Preferably, the absolute angle in the hoop layer is substantially 90 degrees to the axial direction of the shaft. However, the orientation angle of the fiber to the axial direction of the shaft might not be completely set to 90 degrees due to an error or the like in winding. In the hoop layer, the orientation angle is usually −90 degrees or greater and −80 degrees or less, or 80 degrees or greater and 90 degrees or less. In other words, in the hoop layer, the absolute angle is usually 80 degrees or greater and 90 degrees or less.

The number of plies (number of windings) of one sheet is not limited. For example, when the number of plies of the sheet is 1, the sheet is wound by one round in the circumferential direction. For example, when the number of plies of the sheet is 2, the sheet is wound by two rounds in the circumferential direction. For example, when the number of plies of the sheet is 1.5, the sheet is wound by 1.5 rounds in the circumferential direction.

From the viewpoint of suppressing winding fault such as wrinkles, a sheet having an excessively large width is not preferable. In this respect, the number of plies of one bias sheet is preferably less than or equal to 4, and more preferably less than or equal to 3. From the viewpoint of the working efficiency of the winding process, the number of plies of one bias sheet is preferably greater than or equal to 1.

From the viewpoint of suppressing winding fault such as wrinkles, a sheet having an excessively large width is not preferable. In this respect, the number of plies of one straight sheet is preferably less than or equal to 4, more preferably less than or equal to 3, and still more preferably less than or equal to 2. From the viewpoint of the working efficiency of the winding process, the number of plies of one straight sheet is preferably greater than or equal to 1. The number of plies may be 1 in all the straight sheets.

In a full length sheet, winding fault is apt to occur. From the viewpoint of suppressing the winding fault, the number of plies of one sheet in all full length straight sheets is preferably less than or equal to 2. The number of plies may be 1 in all the full length straight sheets.

From the viewpoint of suppressing winding fault such as wrinkles, a sheet having an excessively large width is not preferable. In this respect, the number of plies of one hoop sheet is preferably less than or equal to 4, more preferably less than or equal to 3, and still more preferably less than or equal to 2. From the viewpoint of the working efficiency of the winding process, the number of plies of one hoop sheet is preferably greater than or equal to 1. In all the hoop sheets (hoop layers), the number of plies may be less than or equal to 2. In all the hoop sheets (hoop layers), the number of plies may be 1.

Winding fault is apt to occur in the full length sheet. From the viewpoint of suppressing the winding fault, the number of plies of one sheet in all full length hoop sheets is preferably less than or equal to 2. The number of plies may be 1 in all the full length hoop sheets.

Although not shown in the drawings, the prepreg sheet before being used is sandwiched between cover sheets. The cover sheets are usually a mold release paper and a resin film. The prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a surface of a mold release paper side", and the surface on which the resin film is applied is also referred to as "a surface of a film side".

In the developed view of the present disclosure, the surface of the film side is the front side. That is, in FIG. 3, the front side of the figure is the surface of the film side, and the back side of the figure is the surface of the mold release paper side.

In order to wind the prepreg sheet, the resin film is first peeled. The surface of the film side is exposed by peeling the resin film. The exposed surface has tacking property (tackiness). The tacking property is caused by the matrix resin. That is, since the matrix resin is in a semi-cured state, the tackiness is developed. The edge part of the exposed surface of the film side is also referred to as a winding start edge part. Next, the winding start edge part is applied to an object to be wound. The winding start edge part can be smoothly applied by the tackiness of the matrix resin. The object to be wound is a mandrel or a wound article obtained by winding other prepreg sheet(s) around the mandrel. Next, the mold release paper is peeled. Next, the object to be wound is rotated to wind the prepreg sheet around the object. In this way, after the resin film is peeled and the winding start edge part is applied to the object to be wound, the mold release paper is peeled. This procedure suppresses wrinkles and winding fault of the sheet. This is because the sheet to which the mold release paper is applied is supported by the mold release paper, and is less likely to cause wrinkles. The flexural rigidity of the mold release paper is higher than that of the resin film.

In the embodiment of FIG. 3, some of the sheets are used as a united sheet. The united sheet is formed by sticking two or more sheets together. All the hoop sheets are wound in the state of the united sheet. The winding fault of the hoop sheet is suppressed by this winding method.

As described above, in the present disclosure, the sheets and the layers are classified by the orientation angle of the fiber. Furthermore, in the present disclosure, the sheets and the layers are classified by their length in the axial direction.

In the present disclosure, a layer substantially wholly disposed in the axial direction of the shaft 6 is referred to as a full length layer. In the present disclosure, a sheet substantially wholly disposed in the axial direction of the shaft is referred to as a full length sheet. The wound full length sheet forms the full length layer.

A region between the tip end TP and a position separated in the axial direction by 20 mm from the tip end Tp is defined as a first region. A region between the butt end Bt and a position separated in the axial direction by 100 mm from the butt end Bt is defined as a second region. The first region and the second region have a limited influence on the performance of the shaft. In this respect, the full length sheet need not be present either in the first region or in the second region. Preferably, the full length sheet extends from the tip end Tp to the butt end Bt. In other words, the full length sheet is preferably wholly disposed in the axial direction of the shaft.

In the present disclosure, a layer partially disposed in the axial direction of the shaft is referred to as a partial layer. In the present disclosure, a sheet partially disposed in the axial direction of the shaft is referred to as a partial sheet. The wound partial sheet forms the partial layer. The axial-direction length of the partial sheet is shorter than the axial-direction length of the full length sheet. Preferably, the axial-direction length of the partial sheet is shorter than or equal to half the full length of the shaft.

In the present disclosure, a layer that is the full length layer and the straight layer is referred to as a full length straight layer. In the embodiment of FIG. 3, the full length straight layers are a layer s6, a layer s8 and a layer s10. The full length straight sheets are the sheet s6, the sheet s8 and the sheet s10.

In the present disclosure, a layer that is the full length layer and the hoop layer is referred to as a full length hoop layer. In the embodiment of FIG. 3, the full length hoop layers are the layer s3 and the layer s9. The full length hoop sheets are the sheet s3 and the sheet s9.

In the present disclosure, a layer that is the partial layer and the straight layer is referred to as a partial straight layer. In the embodiment of FIG. 3, the partial straight layers are a layer s1 and a layer s11. Partial straight sheets are the sheet s1 and the sheet s11.

In the present disclosure, a layer that is the partial layer and the hoop layer is referred to as a partial hoop layer. In the embodiment of FIG. 3, the partial hoop layers are the layer s5 and the layer s7. Partial hoop sheets are the sheet s5 and the sheet s7.

The term "butt partial layer" is used in the present disclosure. Examples of the butt partial layer include a butt partial straight layer and a butt partial hoop layer. The embodiment of FIG. 3 does not include the butt partial straight layer.

The embodiment of FIG. 3 includes the butt partial hoop layer s5 and the butt partial hoop layer s7. One end of the butt partial hoop layer s5 is located at the butt end Bt. One end of the butt partial hoop layer s7 is located at the butt end Bt. The embodiment of FIG. 3 includes the plurality of butt partial hoop layers s5 and s7.

An axial-direction distance between the butt partial layer (butt partial sheet) and the butt end Bt is preferably less than or equal to 100 mm, more preferably less than or equal to 50 mm, and still more preferably 0 mm. In the present embodiment, this distance is 0 mm in all the butt partial layers.

The term "tip partial layer" is used in the present disclosure. An axial-direction distance between the tip partial layer (tip partial sheet) and the tip end Tp is preferably less than or equal to 40 mm, more preferably less than or equal to 30 mm, still more preferably less than or equal to 20 mm, and yet still more preferably 0 mm. In the present embodiment, this distance is 0 mm in all the tip partial layers.

Examples of the tip partial layer include a tip partial straight layer. In the embodiment of FIG. 3, the tip partial straight layers are the layer s1 and the layer s11. Tip partial straight sheets are the sheet s1 and the sheet s11.

The shaft 6 is produced by the sheet-winding method using the sheets shown in FIG. 3.

Hereinafter, manufacturing processes of the shaft 6 will be schematically described.

[Outline of Manufacturing Processes of Shaft]

(1) Cutting Process

The prepreg sheet is cut into a desired shape in the cutting process. Each of the sheets shown in FIG. 3 is cut out by the process.

The cutting may be performed by a cutting machine. The cutting may be manually performed. In the manual case, for example, a cutter knife is used.

(2) Sticking Process

In the sticking process, the united sheet described above is produced. In the shaft 6, the sheet s2, the sheet s3 and the sheet s4 are stuck together to produce a united sheet s234. Further, the sheet s5 and the sheet s6 are stuck together to produce a united sheet s56. Further, the sheet s7 and the sheet s8 are stuck together to produce a united sheet s78. Further, the sheet s9 and the sheet s10 are stuck together to produce a united sheet s910.

In the sticking process, heating or a press may be used. More preferably, the heating and the press are used in combination. In a winding process to be described later, deviation between the sheets might occur during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets are wound in order described in the developed view. The sheet located on a more upper side in the developed view is earlier wound. The sheets to be stuck together are wound in the state of the united sheet. A sheet having a low resin content does not have a sufficient tackiness and causes deterioration in workability of winding. Workability of winding of such a low-resin-content sheet is improved by using the sheet as a part of the united sheet in combination with a sheet having a high resin content.

A winding body is obtained in the winding process. The winding body is obtained by winding the prepreg sheets around the outside of the mandrel. For example, the winding is achieved by rolling the object to be wound on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. The tape applies pressure to the winding body. The pressure can eliminate voids.

(5) Curing Process

In the curing process, the winding body after performing the tape wrapping is heated. The heating cures the matrix resin. In the curing process, the matrix resin fluidizes temporarily. The fluidization of the matrix resin can eliminate voids between the sheets or in each sheet. The pressure (fastening force) of the wrapping tape accelerates the elimination of the voids. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel from the viewpoint of improving the efficiency of the process of removing the wrapping tape.

(7) Process of Cutting Off Both Ends

Both end portions of the cured laminate are cut off in the process. The cutting off flattens the end face of the tip end Tp and the end face of the butt end Bt.

For the sake of easy understanding, the sheets after both the ends are cut off are shown in the developed view of the present disclosure. In fact, each sheet is cut out while considering dimensions for the cutting off of both the ends. That is, in fact, each sheet is cut out so as to have dimensions in which both end portions to be cut off are added to the desired shape.

(8) Polishing Process

The surface of the cured laminate is polished in the process. Spiral unevenness is present on the surface of the cured laminate. The unevenness is the trace of the wrapping tape. The polishing removes the unevenness to smooth the surface of the cured laminate. In addition, the surface of the cured laminate is a shiny surface, and thus coating does not adhere to the surface. The polishing allows the coating to adhere to the polished surface of the cured laminate. Preferably, whole polishing and tip partial polishing are performed in the polishing process.

(9) Coating Process

The cured laminate after the polishing process is subjected to coating.

The shaft 6 is obtained by the above-described processes.

In the shaft according to the present disclosure, an alternate lamination (alternate arrangement) of the hoop layers and the straight layers is formed by using two of the hoop layers and two of the straight layers. In the shaft 6, the alternate arrangement of the hoop layers and the straight layers is formed by using two hoop layers s5, s7 and two straight layers s6, s8. More specifically, the hoop layer s5, the straight layer s6, the hoop layer s7 and the straight layer s8 are arranged in this order from inside.

As described above, the alternate arrangement is formed by using two united sheets each obtained by sticking one hoop sheet and one straight sheet together. That is, the united sheet s78 is wound outside the united sheet s56, thereby attaining the alternate arrangement. The alternate arrangement enables one hoop sheet and one straight sheet to be wound as a set. Winding the straight sheet having a low resin content together with the hoop sheet having a high resin content allows the winding process to be smoothly performed, thereby improving workability.

Since the fiber in the hoop sheet is oriented perpendicularly to the axial direction and only the resin makes the hoop sheet continuous in the axial direction, the hoop sheet is apt to be torn by a force applied in the axial direction. Singly winding the hoop layer is apt to cause wrinkle and/or tear. The hoop layer can be formed with high accuracy by winding the hoop sheet together with the straight sheet in the state of the united sheet. Furthermore, this improves workability in the winding process.

In the alternate arrangement, the resin content of the straight layer is lower than the resin content of the hoop layer. Such a lower resin content tends to cause voids. As described above, the curing process fluidizes the matrix resin temporarily, and thus the voids can be eliminated. However, if the matrix resin is not sufficiently contained, the voids are less eliminated. The alternate arrangement locates the hoop layer adjacent to the straight layer. Therefore, the hoop layer having a high resin content supply its matrix resin to the straight layer having a low resin content. As a result, the elimination of voids in the straight layer having a low resin content can be facilitated (void reduction effect).

In the shaft 6, the alternate lamination of the butt partial hoop layers and the full length straight layers is formed by using the two butt partial hoop layers and two of the full length straight layers. That is, in the shaft 6, the alternate arrangement of the butt partial hoop layers and the full length straight layers is formed by using the two butt partial hoop layers s5, s7 and the two full length straight layers s6, s8. In addition, the length of the first butt partial hoop layer s5 is different from the length of the second butt partial hoop layer s7. For this reason, the amount of the hoop layers is increased toward the butt end Bt, thereby enabling to enhance the void reduction effect in a portion that is apt to have an insufficient crushing strength. This structure also enables to concentrate weight on the butt end portion of the shaft to locate the center of gravity of the shaft closer to the butt end Bt while keeping flexure property of the butt end portion of the shaft. The flexure property of the butt end portion and the center of gravity located close to the butt end Bt enhance ease of swing.

Furthermore, the use of the butt partial hoop layers s5 and s7 reduces the amount of the hoop layers located in the tip end portion of the shaft to reduce the weight of the shaft.

The resin content of the first butt partial hoop layer s5 is lower than the resin content of the second butt partial hoop layer s7. The crushing strength of the shaft can be increasingly reinforced toward the butt end Bt by decreasing the resin content of the first butt partial hoop layer s5 having a shorter length, and by increasing the fiber content of the first butt partial hoop layer s5.

The second butt partial hoop layer s7 is sandwiched between the low Rc layer s6 and the low Rc layer s8. The amount of resin tends to be insufficient in such a portion sandwiched between the low Rc layer s6 and the low Rc layer s8. For this reason, the resin content of the second butt partial hoop layer s7 is increased to enhance the void reduction effect. On the other hand, the immediate outside layer of the first butt partial hoop layer s5 is the low Rc layer s6, whereas the immediate inside layer of the first butt partial hoop layer s5 is the layer s4, not a low Rc layer. In other words, a layer that has a resin content of greater than 20% is disposed immediate inside the first butt partial hoop layer s5. Therefore, the amount of resin in this case is greater as compared with the portion sandwiched between the low Rc layers. In this respect, the first butt partial hoop layer s5 has a lower resin content and a higher fiber content as compared with the second butt partial hoop layer s7. Thus, the first butt partial hoop layer s5 and the second butt partial hoop layer s7 which have respective lengths and resin contents different from each other achieve an optimum balance of the crushing strength and the void reduction effect.

Note that the term "fiber elastic modulus" means the tensile elastic modulus of the fiber contained in a layer.

Further, in the shaft 6, the alternate lamination of the hoop layers and the straight layers is formed by using three of the hoop layers and three of the straight layers.

That is, in the shaft 6, the alternate arrangement of the hoop layers and the straight layers is formed by using the three hoop layers s5, s7, s9 and the three straight layers s6, s8, s10. More specifically, the hoop layer s5, the straight layer s6, the hoop layer s7, the straight layer s8, the hoop layer s9 and the straight layer s10 are arranged in this order from inside. The three sets each including one hoop layer and one straight layer further enhance the void reduction effect.

In the shaft according to the present disclosure, the plurality of hoop layers include a first butt partial hoop layer and a second butt partial hoop layer which is longer in the axial direction than the first butt partial hoop layer. In the shaft 6, the layer s5 can be the first butt partial hoop layer. In the shaft 6, the layer s7 can be the second butt partial hoop layer. The first butt partial hoop layer s5 is disposed inside the second butt partial hoop layer s7. The first butt partial hoop layer s5 may be disposed outside the second butt partial hoop layer s7. The first butt partial hoop layer s5 has a weight per unit area of greater than that of the second butt partial hoop layer s7.

The fiber elastic modulus of the first butt partial hoop layer s5 is smaller than the fiber elastic modulus of the second butt partial hoop layer s7. A hoop layer is difficult to wind since the fiber of the hoop layer is oriented perpendicularly to the axial direction. When the weight per unit area of the hoop layer is greater, the hoop layer is more difficult to wind. Ease of winding the first butt partial hoop layer s5 having a greater weight per unit area is enhanced by decreasing its fiber elastic modulus. On the other hand, the second butt partial hoop layer s7 has a relatively small weight per unit area, and thus is easier to wind as compared with the first butt partial hoop layer s5. For this reason, the fiber elastic modulus of the second butt partial hoop layer s7 is increased. Such a high fiber elastic modulus effectively enhances crushing rigidity.

The shaft 6 has a tapered shape that becomes thinner toward the tip end Tp. The crushing strength tends to deteriorate in the butt end portion having a larger diameter. The weight per unit area of the first butt partial hoop layer s5, which is shorter than the second butt partial hoop layer s7, is made greater, whereby the crushing strength of the portion having a larger diameter can be effectively enhanced. The use of the butt partial straight layer can also enhance the strength of the butt end portion but reduces the degree of flexure of the butt end portion, whereby flight distance performance can be reduced.

The center of gravity of the shaft 6 can be located closer to the butt end Bt by increasing the weight per unit area of the first butt partial hoop layer s5. This shaft 6 can improve the ease of swing of the club.

The weight per unit area of the first butt partial hoop layer s5 is denoted by M1 ($g/m^2$). The weight per unit area of the second butt partial hoop layer s7 is denoted by M2 ($g/m^2$). From the viewpoint of enhancing the above effects, M1/M2 is preferably greater than or equal to 1.5, more preferably greater than or equal to 2.0, still more preferably greater than or equal to 2.5, still more preferably greater than or equal to 2.8, and yet still more preferably greater than or equal to 3.0. From the viewpoint of weight reduction of the shaft, an excessively large M1 is not preferable. In this respect, M1/M2 is preferably less than or equal to 6.0, more preferably less than or equal to 5.0, and still more preferably less than or equal to 4.0.

A double-pointed arrow L1 in FIG. 3 shows the length of the first butt partial hoop layer s5. The length L1 is measured along the axial direction of the shaft. A double-pointed arrow L2 in FIG. 3 shows the length of the second butt partial hoop layer s7. The length L2 is measured along the axial direction of the shaft. From the viewpoint of enhancing the effects brought by the difference in length, L2/L1 is preferably greater than or equal to 1.5, more preferably greater than or equal to 1.7, and still more preferably greater than or equal to 1.8. From the viewpoint of preventing an excessively small L1 and an excessively large L2, L2/L1 is preferably less than or equal to 4.0, more preferably less than or equal to 3.0, and still more preferably less than or equal to 2.0. The length L1 is preferably greater than or equal to 150 mm and less than or equal to 350 mm. The length L2 is preferably greater than or equal to 400 mm and less than or equal to 600 mm.

In the shaft according to the present disclosure, the plurality of hoop layers include a first full length hoop layer and a second full length hoop layer. In the shaft 6, the layer s3 can be the first full length hoop layer. In the shaft 6, the layer s9 can be the second full length hoop layer. The weight per unit area of the first full length hoop layer s3 is the same as the weight per unit area of the second full length hoop layer s9.

In the shaft according to the present disclosure, at least one full length straight layer is disposed between the first full length hoop layer and the second full length hoop layer. In the shaft 6, the full length straight layer s6 and the full length straight layer s8 are disposed between the first full length hoop layer s3 and the second full length hoop layer s9. That is, in the shaft 6, two full length straight layers are disposed between the first full length hoop layer s3 and the second full length hoop layer s9.

The full length hoop layers have the same weight per unit area, and at least one full length straight layer is disposed between the full length hoop layers so that burdens on the respective fiber layers are more equalized, whereby stress can be effectively dispersed. For this reason, the strength of the shaft is improved.

All the layers s1 to s11 have respective resin contents. The resin content means a ratio of the weight of the resin contained in a layer to the whole weight of the layer. The resin content is shown as a specification of a prepreg. The minimum value in resin contents of all the hoop layers is denoted by Rf (%). The maximum value in resin contents of all the straight layers is denoted by Rs (%). In the shaft 6, Rf is greater than or equal to Rs.

A lightweight shaft can be obtained by decreasing the resin content Rs of the straight layers. The above-described void reduction effect is obtained by increasing the resin content Rf of the hoop layers.

In the shaft according to the present disclosure, the plurality of fiber reinforced layers include a low Rc layer that has a resin content of less than or equal to 20% and a high Rc layer that has a resin content of greater than or equal to 24%. In the shaft 6, the layer s6 and the layer s8 are the low Rc layers. In the shaft 6, the layer s1, the layer s3, the layer s5, the layer s7, the layer s9, the layer s10 and the layer s11 are the high Rc layers. All the hoop layers are the high Rc layers.

From the viewpoint of convenience in handling the prepreg, the resin content of the low Rc layer is preferably greater than or equal to 18%. From the viewpoint of shaft strength, the resin content of the high Rc layer is preferably less than or equal to 50%.

In the shaft according to the present disclosure, each of all the low Rc layers is provided together with at least one adjacent high Rc layer located on the immediate inside or the immediate outside of the low Rc layer. In the shaft 6, the high Rc layer s5 is disposed immediate inside the low Rc layer s6, and the high Rc layer s7 is disposed immediate outside the low Rc layer s6. Similarly, the high Rc layer s7 is disposed immediate inside the low Rc layer s8, and the high Rc layer s9 is disposed immediate outside the low Rc layer s8.

The void reduction effect can be further improved by disposing the high Rc layer adjacent to the low Rc layer.

The shaft 6 includes an ultra-high Rc layer that has a resin content of greater than or equal to 30%. In the shaft 6, the layer s1, the layer s3, the layer s7 and the layer s9 are the ultra-high Rc layers. All the hoop layers except the first butt partial hoop layer s5 are the ultra-high Rc layers. The resin content of the ultra-high Rc layer is preferably less than or equal to 50%.

In the shaft according to the present disclosure, each of all the low Rc layers is provided together with at least one adjacent ultra-high Rc layer located on the immediate inside or the immediate outside of the low Rc layer. In the shaft 6, the ultra-high Rc layer s7 is disposed immediate outside the low Rc layer s6. Furthermore, the ultra-high Rc layer s7 is disposed immediate inside the low Rc layer s8, and the ultra-high Rc layer s9 is disposed immediate outside the low Rc layer s8. The void reduction effect can be further improved by disposing the ultra-high Rc layer adjacent to the low Rc layer.

The shaft according to the present disclosure includes a high-elasticity and high-strength layer that has a fiber elastic modulus of greater than or equal to 33 t/mm$^2$ and has a tensile strength of the fiber of greater than or equal to 670 kgf/mm$^2$. In the shaft 6, the high-elasticity and high-strength layers are the layer s6 and the layer s8. These high-elasticity and high-strength layers s6 and s8 are also the low Rc layers. The high-elasticity and high-strength layers s6 and s8 are the straight layers. The high-elasticity and high-strength layers s6 and s8 are the full length straight layers.

The total weight of the high-elasticity and high-strength layers s6 and s8 is denoted by Wh. The total weight of all the straight layers is denoted by Ws. From the viewpoint of obtaining a lightweight and high-strength shaft, Wh/Ws is preferably greater than or equal to 0.45, more preferably greater than or equal to 0.46, still more preferably greater than or equal to 0.47, and yet still more preferably greater than or equal to 0.48. From the viewpoint of costs, Wh/Ws is preferably less than or equal to 0.8, more preferably less than or equal to 0.7, and still more preferably less than or equal to 0.6.

The total weight of the high-elasticity and high-strength layers s6 and s8 which are also the full length straight layers is denoted by Fh. The total weight of all the full length straight layers is denoted by Fs. From the viewpoint of obtaining a lightweight and high-strength shaft, Fh/Fs is preferably greater than or equal to 0.60, more preferably greater than or equal to 0.61, still more preferably greater than or equal to 0.62, and yet still more preferably greater than or equal to 0.63. From the viewpoint of costs, Fh/Fs is preferably less than or equal to 0.9, more preferably less than or equal to 0.85, and still more preferably less than or equal to 0.8.

In the shaft according to the present disclosure, each of all the high-elasticity and high-strength layers is provided together with at least one adjacent high Rc layer located on the immediate inside or the immediate outside of the high-elasticity and high-strength layer. In the shaft 6, the high Rc layer s5 is disposed immediate inside the high-elasticity and high-strength layer s6, and the high Rc layer s7 is disposed immediate outside the high-elasticity and high-strength layer s6. In addition, the high Rc layer s7 is disposed immediate inside the high-elasticity and high-strength layer s8, and the high Rc layer s9 is disposed immediate outside the high-elasticity and high-strength layer s8. This structure enhances the void reduction effect in the high-elasticity and high-strength layers and suppresses void-induced deterioration in excellent properties of the high-elasticity and high-strength layers.

In the shaft according to the present disclosure, each of all the high-elasticity and high-strength layers is provided together with at least one adjacent ultra-high Rc layer located on the immediate inside or the immediate outside of the high-elasticity and high-strength layer. In the shaft 6, the ultra-high Rc layer s7 is disposed immediate outside the high-elasticity and high-strength layer s6. In addition, the ultra-high Rc layer s7 is disposed immediate inside the high-elasticity and high-strength layer s8, and the ultra-high Rc layer s9 is disposed immediate outside the high-elasticity and high-strength layer s8. This structure enhances the void reduction effect in the high-elasticity and high-strength layers and suppresses void-induced deterioration in excellent properties of the high-elasticity and high-strength layers.

In the shaft according to the present disclosure, the alternate lamination of the hoop layers and the high-elasticity and high-strength layers is formed by using two of the hoop layers and the two high-elasticity and high-strength layers. In the shaft 6, the alternate arrangement of the hoop layers and the high-elasticity and high-strength layers is formed by using two hoop layers s5, s7 and two high-elasticity and high-strength layers s6, s8. More specifically, the hoop layer s5, the high-elasticity and high-strength layer s6, the hoop layer s7 and the high-elasticity and high-strength layer s8 are arranged in this order from inside.

The outermost full length straight layer s10 is not the high-elasticity and high-strength layer. The outermost full length straight layer s10 is polished in the polishing process. The high-elasticity and high-strength layers s6 and s8 are not the outermost layer, and thus are not polished. Therefore, the advantageous effects brought by the high-elasticity and high-strength layers s6 and s8 can be maximized.

The shaft 6 including the high-elasticity and high-strength layers is excellent in strength in spite of being lightweight, and exhibits an appropriate shaft flex. From this viewpoint, the weight of the shaft is preferably less than or equal to 40 g. From the viewpoint of restriction on design, the weight of the shaft is preferably greater than or equal to 30 g, more preferably greater than or equal to 32 g, and still more preferably greater than or equal to 34 g.

Below Table 1 and Table 2 show examples of utilizable prepregs. Appropriate prepregs are selected from those commercially available prepregs.

TABLE 1

Samples of utilizable prepregs

| | | | | | | Physical property value of reinforcing fiber | | |
|---|---|---|---|---|---|---|---|---|
| Manufacturer | Trade name | Thickness of sheet (mm) | Weight per unit area (g/m$^2$) | Fiber content (% by weight) | Resin content (% by weight) | Part number of fiber | Tensile elastic modulus (t/mm$^2$) | Tensile strength (kgf/mm$^2$) |
| Toray Industries, Inc. | 3255S-10 | 0.082 | 132 | 76 | 24 | T700S | 24 | 500 |
| Toray Industries, Inc. | 3255S-12 | 0.103 | 165 | 76 | 24 | T700S | 24 | 500 |
| Toray Industries, Inc. | 3255S-15 | 0.123 | 198 | 76 | 24 | T700S | 24 | 500 |
| Toray Industries, Inc. | 2255S-10 | 0.082 | 132 | 76 | 24 | T800S | 30 | 600 |
| Toray Industries, Inc. | 2255S-12 | 0.102 | 164 | 76 | 24 | T800S | 30 | 600 |
| Toray Industries, Inc. | 2255S-15 | 0.123 | 197 | 76 | 24 | T800S | 30 | 600 |
| Toray Industries, Inc. | 2256S-10 | 0.077 | 125 | 80 | 20 | T800S | 30 | 600 |
| Toray Industries, Inc. | 2256S-12 | 0.103 | 156 | 80 | 20 | T800S | 30 | 600 |
| Toray Industries, Inc. | 2276S-10 | 0.077 | 125 | 80 | 20 | T800S | 30 | 600 |
| Toray Industries, Inc. | 805S-3 | 0.034 | 50 | 60 | 40 | M30S | 30 | 560 |
| Toray Industries, Inc. | 8053S-3 | 0.028 | 43 | 70 | 30 | M30S | 30 | 560 |
| Toray Industries, Inc. | 9255S-7A | 0.056 | 92 | 78 | 22 | M40S | 40 | 470 |
| Toray Industries, Inc. | 9255S-6A | 0.047 | 76 | 76 | 24 | M40S | 40 | 470 |
| Toray Industries, Inc. | 9053S-4 | 0.027 | 43 | 70 | 30 | M40S | 40 | 470 |
| Nippon Graphite Fiber Co., Ltd. | E1026A-09N | 0.100 | 151 | 63 | 37 | XN-10 | 10 | 190 |
| Nippon Graphite Fiber Co., Ltd. | E1026A-14N | 0.150 | 222 | 63 | 37 | XN-10 | 10 | 190 |

The tensile strength and the tensile elastic modulus are measured in accordance with "Testing Method for Carbon Fibers" JIS R7601: 1986.

TABLE 2

| Samples of utilizable prepregs | | | | | | | | |
|---|---|---|---|---|---|---|---|---|
| | | | | | | Physical property value of reinforcing fiber | | |
| Manufacturer | Trade name | Thickness of sheet (mm) | Weight per unit area (g/m$^2$) | Fiber content (% by weight) | Resin content (% by weight) | Part number of fiber | Tensile elastic modulus (t/mm$^2$) | Tensile strength (kgf/mm$^2$) |
| Mitsubishi Rayon Co., Ltd. | GE352H-160S | 0.150 | 246 | 65 | 35 | E glass | 7 | 320 |
| Mitsubishi Rayon Co., Ltd. | TR350C-100S | 0.083 | 133 | 75 | 25 | TR50S | 24 | 500 |
| Mitsubishi Rayon Co., Ltd. | TR350U-100S | 0.078 | 126 | 75 | 25 | TR50S | 24 | 500 |
| Mitsubishi Rayon Co., Ltd. | TR350C-125S | 0.104 | 167 | 75 | 25 | TR50S | 24 | 500 |
| Mitsubishi Rayon Co., Ltd. | TR350C-150S | 0.124 | 200 | 75 | 25 | TR50S | 24 | 500 |
| Mitsubishi Rayon Co., Ltd. | TR350C-175S | 0.147 | 233 | 75 | 25 | TR50S | 24 | 500 |
| Mitsubishi Rayon Co., Ltd. | MR350J-025S | 0.034 | 48 | 63 | 37 | MR40 | 30 | 450 |
| Mitsubishi Rayon Co., Ltd. | MR350J-050S | 0.058 | 86 | 63 | 37 | MR40 | 30 | 450 |
| Mitsubishi Rayon Co., Ltd. | MR350C-050S | 0.05 | 67 | 75 | 25 | MR40 | 30 | 450 |
| Mitsubishi Rayon Co., Ltd. | MR350C-075S | 0.063 | 100 | 75 | 25 | MR40 | 30 | 450 |
| Mitsubishi Rayon Co., Ltd. | MRX350C-075R | 0.063 | 101 | 75 | 25 | MR40 | 30 | 450 |
| Mitsubishi Rayon Co., Ltd. | MRX350C-100S | 0.085 | 133 | 75 | 25 | MR40 | 30 | 450 |
| Mitsubishi Rayon Co., Ltd. | MR350C-100S | 0.085 | 133 | 75 | 25 | MR40 | 30 | 450 |
| Mitsubishi Rayon Co., Ltd. | MRX350C-125S | 0.105 | 167 | 75 | 25 | MR40 | 30 | 450 |
| Mitsubishi Rayon Co., Ltd. | MR350C-125S | 0.105 | 167 | 75 | 25 | MR40 | 30 | 450 |
| Mitsubishi Rayon Co., Ltd. | MR350E-100S | 0.093 | 143 | 70 | 30 | MR40 | 30 | 450 |
| Mitsubishi Rayon Co., Ltd. | HRX350C-075S | 0.057 | 92 | 75 | 25 | HR40 | 40 | 450 |
| Mitsubishi Rayon Co., Ltd. | HRX350C-110S | 0.082 | 132 | 75 | 25 | HR40 | 40 | 450 |

The tensile strength and the tensile elastic modulus are measured in accordance with "Testing Method for Carbon Fibers" JIS R7601: 1986.

EXAMPLES

Example 1

A shaft was produced in the same manner as described above. The laminated constitution of the shaft was as shown in FIG. 3. As described above, respective hoop layers were wound in the form of the united sheet s234, the united sheet s56, the united sheet s78, and the united sheet s910. The layer s6 and the layer s8 were the low Rc layers and the high-elasticity and high-strength layers. A prepreg having a resin content of 18% and containing a fiber that was T1100G manufactured by Toray Industries, Inc. was used for the sheet s6 and the sheet s8. The weight per unit area of the first butt partial hoop layer s5 was 133 g/m$^2$. M1/M2 was 3.1. The fiber elastic modulus of the full length straight layer s10 was 24 t/mm$^2$. The weight of the shaft was 40 g. As to the resin content, the minimum value Rf (%) was greater than the maximum value Rs (%). The specifications and evaluation results of Example 1 are shown in the below Table 3.

Note that the term "number of sets in alternate arrangement" shown in Table 3 means the number of sets of one hoop layer and one straight layer in the alternate arrangement of the hoop layers and the straight layers. In the embodiment of FIG. 3, the number of sets is 3. M1/M2 shown in Table 3 means the ratio of the weight per unit area M1 (g/m$^2$) of the first butt partial hoop layer s5 to the weight per unit area M2 (g/m$^2$) of the second butt partial hoop layer s7. Fh/Fs shown in Table 3 means the ratio of the total weight Fh of the high-elasticity and high-strength layers among the full length straight layers to the total weight Fs of all the full length straight layers.

Example 2

A shaft according to Example 2 was obtained in the same manner as in Example 1 except that the first butt partial hoop layer s5 was removed. Note that the weight of the full length straight layer s10 was increased so that the shaft weight in Example 2 was the same as the shaft weight in Example 1. Specifications and evaluation results of Example 2 are shown in below Table 3.

Example 3

A shaft according to Example 3 was obtained in the same manner as in Example 1 except that the order of winding layers was changed so that the second full length hoop layer s9 was wound right after the first full length hoop layer s3 was wound. In the winding process, a united sheet was produced by using two hoop layers and two bias layers, and the united sheet was wound. Specifications and evaluation results of Example 3 are shown in below Table 3.

Example 4

A shaft according to Example 4 was obtained in the same manner as in Example 1 except that the weight per unit area of the first butt partial hoop layer s5 was decreased so as to be the same as the weight per unit area of the second butt partial hoop layer s7. Note that the weight of the full length straight layer s10 was increased so that the shaft weight in Example 4 was the same as the shaft weight in Example 1. Specifications and evaluation results of Example 4 are shown in below Table 3.

Example 5

A shaft according to Example 5 was obtained in the same manner as in Example 1 except that all the high-elasticity and high-strength layers s6 and s8 were substituted by non-high-elasticity and non-high-strength layers. A material having a fiber elastic modulus of 24 t/mm$^2$ and a tensile strength of the fiber of 500 kgf/mm$^2$ was used for the non-high-elasticity and non-high-strength layers. Specifications and evaluation results of Example 5 are shown in below Table 3.

Example 6

A shaft according to Example 6 was obtained in the same manner as in Example 1 except that the high-elasticity and high-strength layer s8 was substituted by a non-high-elasticity and non-high-strength layer. A material having a fiber elastic modulus of 24 t/mm$^2$ and a tensile strength of the fiber of 500 kgf/mm$^2$ was used for the non-high-elasticity and non-high-strength layer. Specifications and evaluation results of Example 6 are shown in below Table 3.

Comparative Example 1

A shaft according to Comparative Example 1 was obtained in the same manner as in Example 1 except that the first butt partial hoop layer s5 was removed, and the second full length hoop layer s9 was wound right after the first full length hoop layer s3 was wound. In the winding process, two hoop layers and two bias layers were used to produce a united sheet, and the united sheet was wound. Note that the weight of the full length straight layer s10 was adjusted so that the shaft weight in Comparative Example 1 was the same as the shaft weight in Example 1. Specifications and evaluation results of Comparative Example 1 are shown in below Table 3.

TABLE 3

Specifications and evaluation results for Examples and Comparative Example

| | Unit | Ex. 1 | Ex. 2 | Ex. 3 | Ex. 4 | Ex. 5 | Ex. 6 | Comp. Ex. 1 |
|---|---|---|---|---|---|---|---|---|
| Shaft weight | gram | 40 | 40 | 40 | 40 | 40 | 40 | 40 |
| Number of sets in alternate arrangement | number | 3 | 2 | 2 | 3 | 3 | 3 | 1 |
| M1/M2 | — | 3.1 | — | 3.1 | 1.0 | 3.1 | 3.1 | — |
| Low Rc layer | — | present | present | present | present | absent | present | present |
| High-elasticity and high-strength layer | — | present | present | present | present | absent | present | present |
| Fh/Fs | — | 0.64 | 0.64 | 0.64 | 0.64 | 0.00 | 0.32 | 0.64 |
| Full length straight layer disposed between full length hoop layers | — | present | present | absent | present | present | present | absent |
| Amount of voids | index | 65 | 80 | 80 | 65 | 60 | 60 | 100 |
| Crushing fracture strength | index | 140 | 110 | 125 | 120 | 130 | 135 | 100 |
| Three-point bending fracture strength | index | 150 | 110 | 135 | 130 | 120 | 135 | 100 |
| Workability | — | A | B | B | A | A | A | C |

[Evaluation Methods]

The evaluation methods are as follows.

[Amount of Voids]

Each of the shafts was cut at a position separated by 175 mm from the butt end Bt, and the cut section was observed by using a microscope to measure areas of voids in the observed image of the cut section. Table 3 shows indices of the areas obtained by setting the value in Comparative Example 1 at 100.

[Crushing Fracture Strength]

Reference positions were set for each of the shafts at positions separated by 550 mm, 650 mm, 750 mm, 850 mm and 950 mm from the tip end Tp, and each of the shafts was cut at positions separated by 5 mm toward both ends from the respective reference positions so that five round-piece specimens each having an axial direction length of 10 mm were cut out. Crushing fracture strength was measured for the respective specimens. A universal testing machine (model: 220X) produced by Intesco Co., Ltd. was used for the measurement. Each specimen was placed on a receiving jig having a horizontal flat top surface, and was compressed by using an indenting jig. The indenting jig was moved vertically downward to compress the specimen, and the load when the specimen was completely fractured was measured. The specimen was compressed in the radial direction (direction in which the cross section is crushed). The bottom surface of the indenting jig, which presses the specimen, was a flat surface parallel to the top surface of the receiving jig. The downwardly moving speed of the indenting jig was 5 mm/min. The average of measured loads at the five positions was defined as the crushing fracture strength of the shaft. Table 3 shows indices of the crushing fracture strength obtained by setting the value of Comparative Example 1 at 100.

[Three-Point Bending Fracture Strength]

The three-point bending fracture strength was measured in compliance with the qualification requirements and conformity confirmation methods for golf club shafts defined by Consumer Product Safety Association in Japan. C point (a point separated by 175 mm from the butt end Bt) defined by the requirements was measured. The above Table 3 shows indices of the three-point bending fracture strength obtained by setting the value in Comparative Example 1 at 100.

[Workability]

Workability of the winding process was evaluated based on work hours. The workability was evaluated on a scale of A, B and C. A indicates the highest workability. C indicates the lowest workability. B indicates medial workability. The evaluation results are shown in Table 3.

As shown in the evaluation results, the advantages of the shafts of the present disclosure are apparent.

Regarding the above-described embodiments, the following clauses are disclosed.

[Clause 1]

A golf club shaft comprising a plurality of fiber reinforced layers, wherein the fiber reinforced layers include a plurality of hoop layers and a plurality of straight layers, the straight layers include at least one full length straight layer, and at least two of the hoop layers and at least two of the straight layers constitute an alternate lamination of the hoop layers and the straight layers.

[Clause 2]

The golf club shaft according to clause 1, wherein the hoop layers include a first butt partial hoop layer and a second butt partial hoop layer that is longer in an axial direction than the first butt partial hoop layer, and the first butt partial hoop layer has a weight per unit area of greater than a weight per unit area of the second butt partial hoop layer.

[Clause 3]

The golf club shaft according to clause 2, wherein the first butt partial hoop layer has a resin content of smaller than a resin content of the second butt partial hoop layer.

[Clause 4]

The golf club shaft according to clause 3, wherein each low Rc layer that has a resin content of less than or equal to 20% is disposed immediate inside and immediate outside the second butt partial hoop layer, and a layer that has a resin content of greater than 20% is disposed immediate inside or immediate outside the first butt partial hoop layer.

[Clause 5]

The golf club shaft according to any one of clauses 1 to 4, wherein the hoop layers further include a first full length hoop layer and a second full length hoop layer, the first full length hoop layer and the second full length hoop layer have a same weight per unit area, the full length straight layer is disposed between the first full length hoop layer and the second full length hoop layer.

[Clause 6]

The golf club shaft according to any one of clauses 1 to 5, wherein a minimum value in resin contents of all the hoop layers is denoted by Rf (%), a maximum value in resin contents of all the straight layers is denoted by Rs (%), and Rf is greater than or equal to Rs.

[Clause 7]

The golf club shaft according to any one of clauses 1 to 6, wherein the fiber reinforced layers include at least one low Rc layer that has a resin content of less than or equal to 20%, and at least one high Rc layer that has a resin content of greater than or equal to 24%, and each of all the at least one low Rc layer is provided together with the at least one high Rc layer which is located at least either on an immediate inside or on an immediate outside of the low Rc layer.

[Clause 8]

A golf club shaft comprising a plurality of fiber reinforced layers, wherein the fiber reinforced layers include a plurality of hoop layers and a plurality of straight layers, the straight layers include at least one high-elasticity and high-strength layer that has a fiber elastic modulus of greater than or equal to 33 $t/mm^2$ and a fiber tensile strength of greater than or equal to 670 $kgf/mm^2$.

[Clause 9]

The golf club shaft according to clause 8, wherein the straight layers include a plurality of full length straight layers, the full length straight layers include the at least one high-elasticity and high-strength layer, a weight of the at least one high-elasticity and high-strength layer among the full length straight layers is denoted by Fh, a total weight of all the full length straight layers is denoted by Fs, and Fh/Fs is greater than or equal to 0.60.

[Clause 10]

The golf club shaft according to clause 8 or 9, wherein the at least one high-elasticity and high-strength layer is a low Rc layer that has a resin content of less than or equal to 20%.

[Clause 11]

The golf club shaft according to any one of clauses 8 to 10, wherein the at least one high-elasticity and high-strength layer is a full length straight layer.

[Clause 12]

The golf club shaft according to any one of clauses 8 to 11, wherein the shaft has a weight of less than or equal to 40 g.

[Clause 13]

The golf club shaft according to any one of clauses 8 to 12, wherein the at least one high-elasticity and high-strength layer comprises a plurality of high-elasticity and high-strength layers, and at least two of the hoop layers and at least two of the high-elasticity and high-strength layers constitute an alternate lamination of the hoop layers and the high-elasticity and high-strength layers.

The above description is merely an example, and various changes can be made without departing from the essence of the present disclosure.

What is claimed is:

1. A golf club shaft comprising a plurality of fiber reinforced layers, wherein the fiber reinforced layers include a plurality of hoop layers and a plurality of straight layers, the straight layers include at least one full length straight layer, and at least two of the hoop layers and at least two of the straight layers constitute an alternate lamination of the hoop layers and the straight layers, wherein the hoop layers include a first butt partial hoop layer and a second butt partial hoop layer that is longer in an axial direction than the first butt partial hoop layer, and the first butt partial hoop layer has a weight per unit area of greater than a weight per unit area of the second butt partial hoop layer.

2. The golf club shaft according to claim 1, wherein the first butt partial hoop layer has a resin content of smaller than a resin content of the second butt partial hoop layer.

3. The golf club shaft according to claim 2, wherein each low Rc layer that has a resin content of less than or equal to 20% is disposed immediate inside and immediate outside the second butt partial hoop layer, and a layer that has a resin content of greater than 20% is disposed immediate inside or immediate outside the first butt partial hoop layer.

4. The golf club shaft according to claim 1, wherein the hoop layers include a first full length hoop layer and a second full length hoop layer, the first full length hoop layer and the second full length hoop layer have a same weight per unit area, and the full length straight layer is disposed between the first full length hoop layer and the second full length hoop layer.

5. The golf club shaft according to claim 1, wherein a minimum value in resin contents of all the hoop layers is denoted by Rf (%), a maximum value in resin contents of all the straight layers is denoted by Rs (%), and Rf is greater than or equal to Rs.

6. The golf club shaft according to claim 1, wherein the fiber reinforced layers include at least one low Rc layer that has a resin content of less than or equal to 20%, and at least one high Rc layer that has a resin content of greater than or equal to 24%, and each of all the at least one low Rc layer is provided together with the at least one high Rc layer which is located at least either on an immediate inside or on an immediate outside of the low Rc layer.

7. The golf club shaft according to claim 1, wherein the golf club shaft does not include a butt partial straight layer.

8. The golf club shaft according to claim 1, wherein the hoop layers comprise at least three hoop layers, the straight layers comprise at least three straight layers, and the at least three hoop layers and the at least three straight layers constitute the alternate lamination of the hoop layers and the straight layers.

9. The golf club shaft according to claim 1, wherein the weight per unit area of the first butt partial hoop layer is denoted by M1, the weight per unit area of the second butt partial hoop layer is denoted by M2, and M1/M2 is greater than or equal to 1.5 and less than or equal to 6.0.

10. The golf club shaft according to claim 1, wherein the first butt partial hoop layer has a length that is denoted by L1, the second butt partial hoop layer has a length that is denoted by L2, and L2/L1 is greater than or equal to 1.5 and less than or equal to 4.0.

11. The golf club shaft according to claim 1, wherein the first butt partial hoop layer has a length that is denoted by L1, the second butt partial hoop layer has a length that is denoted by L2, L1 is longer than or equal to 150 mm and shorter than or equal to 350 mm, and L2 is longer than or equal to 400 mm and shorter than or equal to 600 mm.

12. The golf club shaft according to claim 1, wherein the hoop layers further include a first full length hoop layer and a second full length hoop layer, the first full length hoop layer and the second full length hoop layer have a same weight per unit area, and the full length straight layer is disposed between the first full length hoop layer and the second full length hoop layer.

13. The golf club shaft according to claim 1, wherein the fiber reinforced layers include at least one low Rc layer that has a resin content of less than or equal to 20%, and at least one ultra-high Rc layer that has a resin content of greater than or equal to 30%, and each of all the at least one low Rc layer is provided together with the at least one ultra-high Rc layer which is located at least either on an immediate inside or on an immediate outside of the low Rc layer.

14. A golf club shaft comprising a plurality of fiber reinforced layers, wherein the fiber reinforced layers include a plurality of hoop layers and a plurality of straight layers, the straight layers include at least one full length straight layer, and at least two of the hoop layers and at least two of the straight layers constitute an alternate lamination of the hoop layers and the straight layers, wherein the hoop layers include a first butt partial hoop layer and a second butt partial hoop layer, and the first butt partial hoop layer has a weight per unit area of greater than a weight per unit area of the second butt partial hoop layer.

* * * * *